United States Patent [19]

Drabowitch

[11] 4,223,316

[45] Sep. 16, 1980

[54] ANTENNA STRUCTURE WITH RELATIVELY OFFSET REFLECTORS FOR ELECTROMAGNETIC DETECTION AND SPACE TELECOMMUNICATION EQUIPMENT

[75] Inventor: Serge Drabowitch, Paris, France

[73] Assignee: Thomson-CSF, Paris, France

[21] Appl. No.: 889,564

[22] Filed: Mar. 23, 1978

[30] Foreign Application Priority Data

Mar. 25, 1977 [FR] France ..... 77 09000

[51] Int. Cl.[2] ..... H01Q 19/12

[52] U.S. Cl. ..... 343/781 P; 343/786; 343/837

[58] Field of Search ..... 343/781 CA, 781 P, 837, 343/840, 753, 786

[56] References Cited

U.S. PATENT DOCUMENTS

| | | | |
|---|---|---|---|
| 2,975,419 | 3/1961 | Brown | 343/755 |
| 3,029,431 | 4/1962 | Miller | 343/837 |
| 3,332,083 | 7/1967 | Broussaud | 343/837 |
| 3,562,753 | 2/1971 | Tanaka et al. | 343/781 CA |
| 3,936,837 | 2/1976 | Coleman et al. | 343/786 |
| 4,012,743 | 3/1977 | Maciejewski | 343/786 |
| 4,062,018 | 12/1977 | Yokoi et al. | 343/781 CA |
| 4,096,483 | 6/1978 | Hai et al. | 343/781 CA |

FOREIGN PATENT DOCUMENTS

| | | | |
|---|---|---|---|
| 2347144 | 4/1974 | Fed. Rep. of Germany | 343/781 P |

*Primary Examiner*—Eli Lieberman
*Attorney, Agent, or Firm*—Karl F. Ross

[57] ABSTRACT

An antenna structure includes an at least partly parabolic main reflector and an auxiliary reflector of generally similar configuration, the two reflectors having confronting concave surfaces and lying respectively above and below a horizontal plane including a common focus of these surfaces. A corrugated horn illuminating the auxiliary reflector extends at the level of the latter, with a substantially horizontal axis, between vertical planes passing through the vertex of the parabolic main-reflector surface and through the common focus; in one embodiment, the horn forms with the auxiliary reflector a unitary assembly closed on all sides except for an upper aperture facing the main reflector.

7 Claims, 6 Drawing Figures

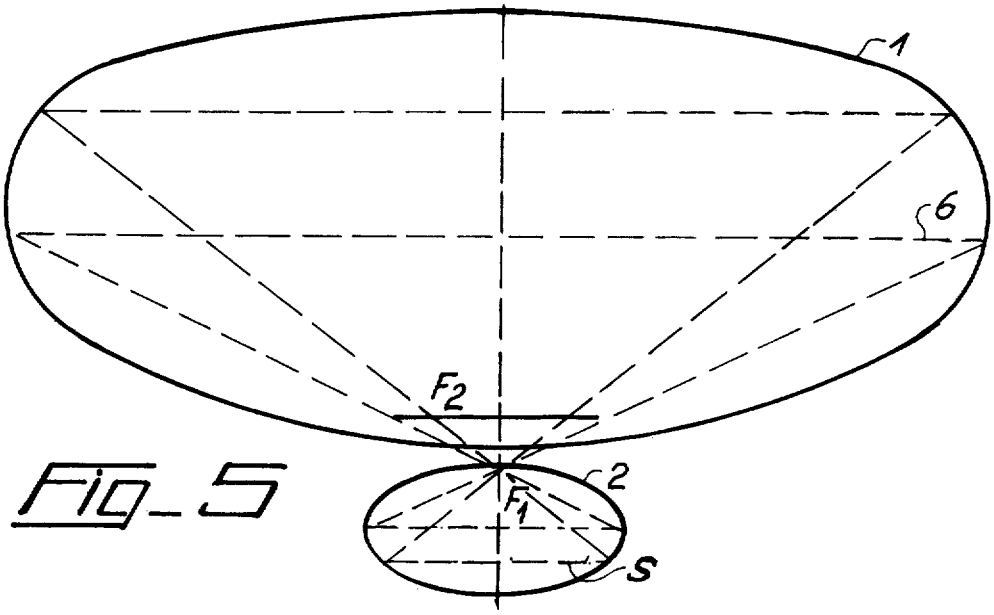
Fig_5
Fig_6
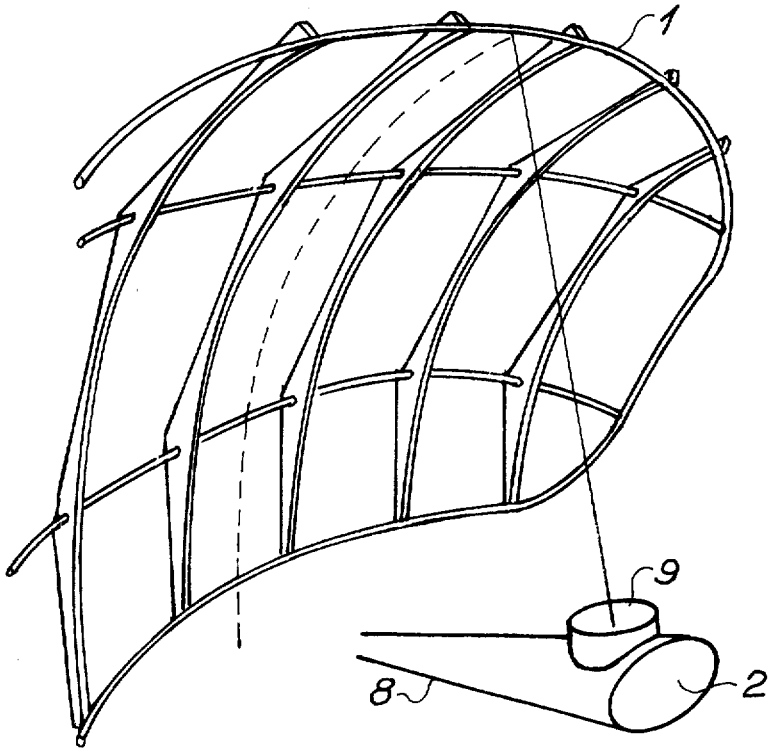

ANTENNA STRUCTURE WITH RELATIVELY OFFSET REFLECTORS FOR ELECTROMAGNETIC DETECTION AND SPACE TELECOMMUNICATION EQUIPMENT

FIELD OF THE INVENTION

My present invention relates to an antenna structure employing relatively offset reflectors, in particular reflectors of the Gregory type.

BACKGROUND OF THE INVENTION

It is known that the reflector antennas which are generally used with microwave frequencies often employ aligned structures in which the primary feed is positioned in front of the reflector. Double-reflector Cassegrain systems are generally aligned with the auxiliary reflector positioned on the axis of the main reflector. However, in such structures the primary feed or the auxiliary reflector is so positioned that they form obstacles to radiation from or to the main reflector, producing what is known as a masking effect which results principally in a reduction in the gain of the antenna and an increase in the level of the side lobes. To overcome this drawback, use is sometimes made with Cassegrain structures of the method known as rotating the plane of polarization involving utilization of an auxiliary reflector composed of parallel wires or plates which are transparent to one polarization. However, this method is only economical when applied to small reflectors and in principle is compatible only with linear polarization. With circular polarization it would be necessary to use an external polarizer covering the whole of the antenna. To avoid the masking effect, ancillary reflectors are often employed whose primary feed is offset from the radiation zone of the main reflector, the latter generally possessing a plane of symmetry. Nevertheless, this technique still has one disadvantage; even when illuminated by an emitter of waves with pure polarization, such as a Huygens source, the reflector produces a cross-polarization radiation pattern which is antisymmetrical about the plane of symmetry. With circular polarization this phenomenon becomes apparent as an angular error in the direction of the main lobe, an increase in the ellipticity level of the radiated wave, and an asymmetry in the changes in the latter level relative to the plane of symmetry of the antenna.

Besides the losses of gain which result from them, these phenomena also cause a reduction in the rejection factor for rain echoes in radars employing circular polarization and a deterioration in the accuracy and angular stability of tracking radars.

To alleviate these problems, which are related to the curvature of the reflector, it is necessary to increase the focal length of the latter. Apart from the resultant increase in size, this procedure calls for high-gain primary feeds and the spillover from these at the periphery of the reflector gives rise to undesirable interference radiation, false echoes, and sensitivity to jamming sources or to terrestrial heat radiation in the case of a space telecommunication antenna.

OBJECTS OF THE INVENTION

An object of my present invention is to provide an antenna structure employing relatively offset reflectors which does not suffer from the disadvantages set forth above.

Another object is to provide an antenna structure of this type having a high gain factor, a favorable radiation pattern and low side lobes.

SUMMARY OF THE INVENTION

An antenna structure according to my invention, wherein a main reflector has a first concave surface which is of substantially parabolic shape over at least a major portion thereof and which confronts a second concave surface of an auxiliary reflector, the two concave surfaces conforming generally homothetically to each other about a common focus. The two reflectors lie on opposite sides of an intervening plane which includes the common focus while a preferably corrugated horn illuminating the auxiliary reflector has an axis substantially parallel to that intervening plane and extends between first and second transverse planes perpendicular to the intervening plane. The first transverse plane passes through the vertex of the substantially parabolic portion of the first concave surface while the second transverse plane passes through the common focus. Thus, electromagnetic radiation emitted by the horn travels only a short distance before reaching the surface of the auxiliary reflector.

According to a more particular feature of my invention, the horn has a mouth close to the first transverse plane and an illuminating aperture larger than its mouth approaching the second transverse plane. In some instances, especially when the surface of the auxiliary reflector is of parabolic shape, a collimating lens may be inserted between that surface and the illuminating aperture of the horn.

BRIEF DESCRIPTION OF THE DRAWING

The above and other features of my invention will become apparent from the ensuing description given with reference to the accompanying drawings in which:

FIG. 5 is a plan view of the structure of FIG. 4; and

FIG. 6 is an antenna structure in which the auxiliary reflector is combined with a feed horn.

DETAILED DESCRIPTION

Figure 1:
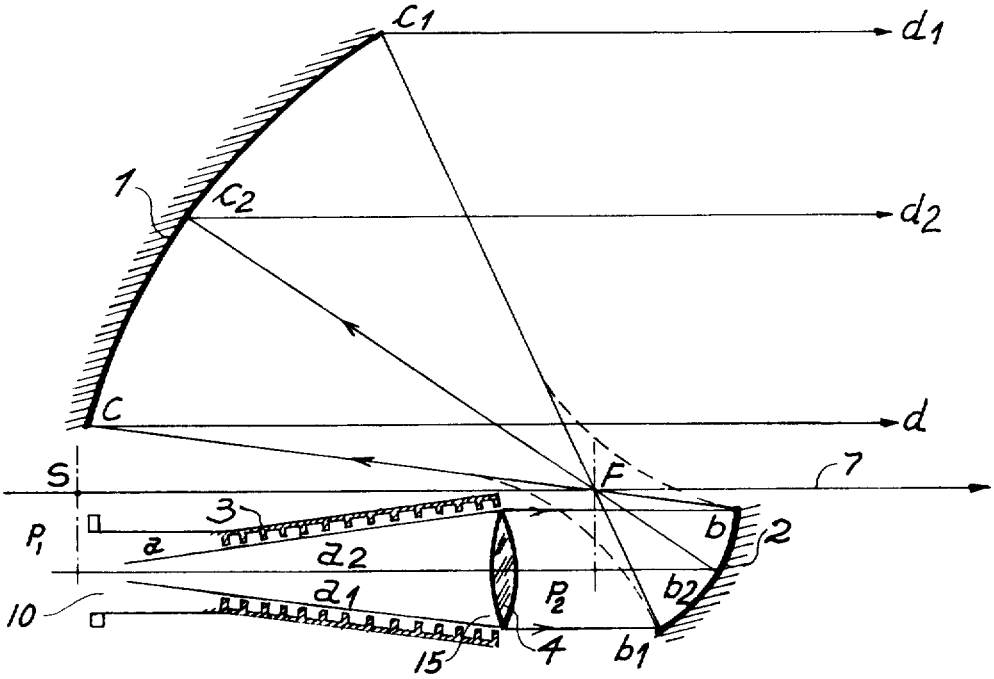
FIG. 1 is an antenna structure according to the invention having parabolic main and auxiliary reflectors.

FIG. 1 shows an antenna structure employing offset reflectors including a concave main reflector 1 of parabolic form and a concave auxiliary reflector 2 of similar parabolic form. The two reflectors are relatively offset, thus obviating any masking effect. The second reflector 2 is illuminated by a feed 3 having substantially pure polarization shown in the Figure as a corrugated horn. In addition, the reflectors 1 and 2 are homothetic, or at least approximately so, about a real point F which also acts as an intermediate focus for the structure as a whole.

The auxiliary reflector 2 is illuminated under near-field conditions by the corrugated horn 3. The waves emerging (if transmission is considered) from the horn 3 are slightly spherical and may make it necessary for a collimating lens 4 to be inserted at the exit from the horn to ensure that the near field is a planar wave. If the corrugated feed horn is close to hybrid equilibrium it is known that it will then behave as an ideal Huygens source, i.e. one whose polarization is pure. The illumination of reflector 2 by the planar wave issuing from the outer face of the lens is of constant polarization with an approximately Gaussian amplitude pattern. The paths of certain rays a-b-c-d, $a_1$-$b_1$-$c_1$-$d_1$, $a_2$-$b_2$-$c_2$-$d_2$, all intersecting in focal point F, are shown in FIG. 1.

Figure 2:
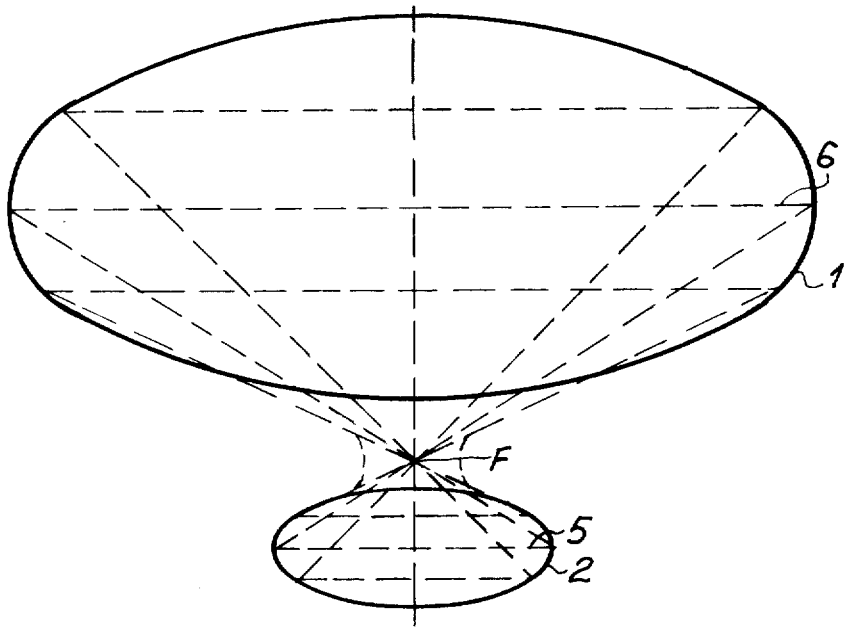
FIG. 2 is a plan view of the structure of FIG. 1.

If the system is assumed to approximate the optical geometry corresponding to the standing-phase conditions which prevail in the near-field region, and if for example the polarization of the horn is assumed to be horizontal, it will be seen in the plan view of FIG. 2 that the current lines 5 for the auxiliary reflector 2 represent sections through this reflector in horizontal planes. Since the reflectors are homothetic relative to the focus F, the corresponding current lines 6 for the main reflector 1 similarly represent sections through the reflector in horizontal planes. In the aperture of the main reflector, which forms the aperture of the structure, the illumination is of constant horizontal polarization. There is no cross-polarization as is the case with prior-art offset antenna structures.

If the parabolic surface of the main reflector 1 has a vertex S, it will be noted that the length of the corrugated horn 3 between its mouth 10 and its illuminating aperture 15 is not much less than the distance SF, which represents an intermediate focal length of the structure. This allows the auxiliary reflector to be illuminated under near-zone conditions. Since the field of the wave reflected by the auxiliary reflector 2 is concentrated near point F, the feed horn, which extends between vertical planes $P_1$ and $P_2$ respectively passing through vertex S and focus F, does not cause any blanking effect. This arrangement makes it possible to minimize overspill around the auxiliary reflector. The two reflectors 1 and 2 respectively lie above and below a horizontal plane including the paraboloid axis 7 which passes through focus F and vertex S.

It may also be mentioned that the use of a corrugated horn radiating under near-field conditions, combined with the fact that the distribution of the field is Gaussian, means that there is a rapid fall-off in the field outside the reflector, which results in a very low level of overspill radiation and even perhaps in its total suppression. What is more, the variance in this distribution is very stable as a function of frequency and this means that the illumination achieved is in turn very stable in terms of frequency.

The actual form of this illumination is furthermore conducive to very low side lobes.

Thus, the advantage which can be achieved with an antenna structure according to the invention are apparent.

However, there exist various modifications of the structure described with reference to FIG. 1 which, while conforming to the basic features of the invention, offer other advantages.

For example, the lens 4 shown in FIG. 1 between the aperture of the corrugated horn 3 and the auxiliary reflector 2 is not essential, provided the horn is sufficiently long, even if the auxiliary reflector closely approximates a paraboloid.

Figure 3:
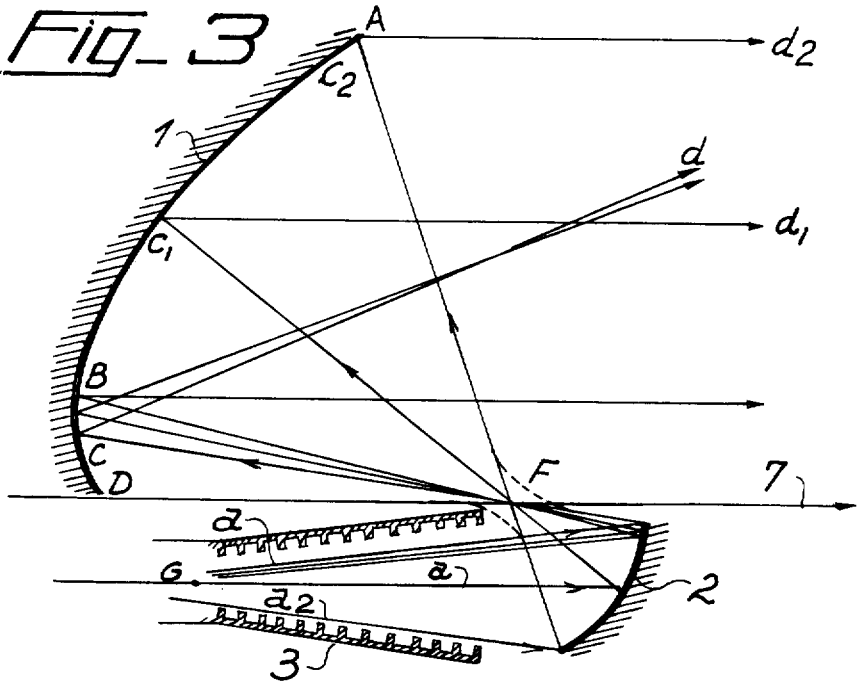
FIG. 3 is an antenna structure according to the invention having a dual-curvature main reflector and an elliptical auxiliary reflector.

FIG. 3 shows an antenna structure according to the invention in which the auxiliary reflector 2 is a segment of an ellipsoid. The lens 4 is not required in this case. The ellipsoid of which the auxiliary reflector 2 is part has one of its foci at F, which is the center of homothety of the structure, and its other focus at G, which is the phase center of the near field radiated by the corrugated horn 3.

In FIG. 3 I have also shown that the main reflector 1 need not be parabolic over its entire working surface. In this Figure, its upper part AB remains parabolic in configuration but its lower part BD is deformed into a C-shaped curvature in the vertical plane of the drawing. This configuration makes it possible, with known techniques, to form the elevation radiation pattern as a cosecant pattern, for example.

It may be mentioned that the deformed lower part of the main reflector tends to elevate the incident beams to positive elevations. Because of this, both the intervening plane at the level 7 of focus F and the feed horn 3 lying just below that intervening plane may be raised without any danger of blanking. The resulting structure is more compact.

It may also be mentioned that a structure such as that shown in FIG. 3 still meets the criteria of the invention, in particular the requirement for homothety, particularly in the parabolic part of the main reflector which gives rise to the field of parallel rays such as $c_1$-$d_1$ and $c_2$-$d_2$ in the upper portion of the diagram.

In the embodiments described above it is assumed that the polarization is horizontal. The arguments remain valid for any kind of polarization be it vertical or even circular.

In certain cases the outline of the reflectors may be other than circular. To ensure that the main reflector is suitably illuminated nevertheless, a corrugated horn of rectangular cross-section is used.

It is also possible to retain the illuminating horn of circular cross-section and use a dual-curvature (astigmatic) auxiliary reflector.

Figure 4:
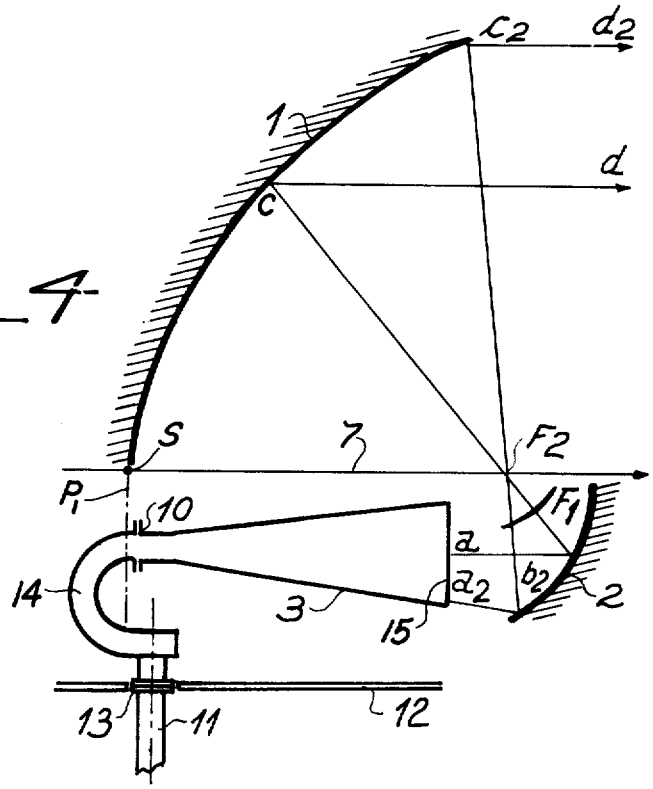
FIG. 4 is another antenna structure having a dual-curvature auxiliary reflector and a main reflector of non-circular profile.

FIGS. 4 and 5 are a cross-sectional view and a plan view, respectively, of such a structure. The vertical and horizontal cross-section of reflector 2, seen respectively in FIGS. 4 and 5 are of different curvatures so that illumination is ensured for the main reflector 1 of non circular outline. At $F_1$ and $F_2$ I have shown the focal lines of this astigmatic system.

The foregoing discussion has assumed the use of corrugated horns which, by virtue of their intrinsic properties, enable antenna structures according to the invention to be produced. However, in cases where the frequency band to be covered is narrow, the single-mode horn 3 may advantageously be replaced by a multimode horn, which is easier to manufacture.

In FIG. 6 I have shown a modified antenna structure according to the invention wherein the illuminating horn and the auxiliary reflector are formed as an assembly 8 which is closed except at the top 9.

With further reference to FIG. 4, other advantages which are directly attributable to the structure according to the invention may be mentioned. The main reflector is not of great focal length, which facilitates a reduction in the longitudinal dimension of the structure, and the mouth 10 of the horn 3 is close to the axis of a vertical shaft 11 which is journaled in a pedestal 12 by a rotary joint 13 and is linked with the horn mouth via a short coupler 14. In FIG. 4, as in FIG. 1, the horn mouth 10 lies close to a vertical plane $P_1$ tangent to the parabolic reflector 1 at its vertex S.

It may also be mentioned that in cases where the invention is applied to a tracking-antenna structure, the horn which is used as a primary feed to illuminate the auxiliary reflector may be advantageously operated in the monopulse mode.

What is claimed is:

1. An antenna structure comprising:

a main reflector of noncircular outline with a first concave surface of substantially parabolic shape;

an auxiliary reflector with an astigmatic second concave surface confronting said first concave surface and conforming generally homothetically thereto about a common focal line, said reflectors lying on opposite sides of an intervening plane including said focal line; and a horn of circular cross-section with an axis substantially parallel to said intervening plane extending on the side of said auxiliary reflector between first and second transverse planes respectively passing perpendicularly to said intervening plane through the vertex of said first surface and through said focal line.

2. An antenna structure as defined in claim 1 wherein said horn has a mouth close to said first transverse plane and an illuminating aperture larger than said mouth approaching said second transverse plane.

3. An antenna structure as defined in claim 2 wherein said horn is provided with a rotary mounting having an axis of rotation close to said first transverse plane.

4. An antenna structure as defined in claim 1 wherein said horn forms with said auxiliary reflector a unitary assembly which is substantially closed except for an aperture facing said first surface.

5. An antenna structure comprising:

a main reflector with a first concave surface having an upper portion of substantially parabolic shape and a lower portion of nonparabolic C-shaped curvature in a vertical plane;

an auxiliary reflector with a second concave surface confronting said first concave surface and conforming generally homothetically thereto about a common focal point, said main and auxiliary reflectors lying respectively above and below an intervening horizontal plane including said focal point, said first surface reflecting rays from said focal point substantially horizontally at said upper portion and with an upward slant at said lower portion; and a horn with a substantially horizontal axis extending below said intervening plane between first and second transverse planes respectively passing perpendicularly to said intervening and vertical planes through the vertex of said upper portion and through said common focus.

6. An antenna structure as defined in claim 5 wherein said second surface is a segment of an ellipsoid having another focal point which lies within said horn at the phase center of radiation emitted thereby.

7. An antenna structure as defined in claim 5 wherein said horn is corrugated.

* * * * *